US011747844B2

(12) United States Patent
Hsu et al.

(10) Patent No.: US 11,747,844 B2
(45) Date of Patent: Sep. 5, 2023

(54) VOLTAGE REGULATOR

(71) Applicant: ALi Corporation, Hsinchu (TW)

(72) Inventors: Chih-Yuan Hsu, Taipei (TW); Chien-Yuan Lu, Taipei (TW)

(73) Assignee: ALi Corporation, Hsinchu (TW)

( * ) Notice: Subject to any disclaimer, the term of this patent is extended or adjusted under 35 U.S.C. 154(b) by 50 days.

(21) Appl. No.: 17/518,589

(22) Filed: Nov. 4, 2021

(65) Prior Publication Data

US 2022/0147080 A1 May 12, 2022

(30) Foreign Application Priority Data

Nov. 9, 2020 (CN) ..... 202011237188.3

(51) Int. Cl.
*G05F 1/46* (2006.01)

(52) U.S. Cl.
CPC ..... *G05F 1/461* (2013.01); *G05F 1/468* (2013.01)

(58) Field of Classification Search
CPC ..... G05F 1/461; G05F 1/468
See application file for complete search history.

(56) References Cited

U.S. PATENT DOCUMENTS

2004/0222950 A1* 11/2004 Kimura ..... G09G 3/325 345/76
2007/0296386 A1* 12/2007 Umeki ..... H02M 1/36 323/284
2013/0063110 A1* 3/2013 Ivanov ..... H02M 3/158 323/280

* cited by examiner

*Primary Examiner* — Jue Zhang
*Assistant Examiner* — Lakaisha Jackson
(74) *Attorney, Agent, or Firm* — JCIPRNET

(57) ABSTRACT

A voltage regulator including an amplifier, a start signal generator and a power transistor is provided. The amplifier has a first positive input terminal, a second positive input terminal, and a negative input terminal to receive a start signal, a reference voltage and a feedback voltage respectively. An output terminal of the amplifier generates a driving voltage. The start signal generator is coupled to the first positive input terminal of the amplifier and generates the start signal, which is incremental, during a startup time interval in a voltage bypass mode. The power transistor generates an output voltage according to the driving voltage based on an operating power. In the voltage bypass mode, the reference voltage is equal to the operating power. A soft-start effect can be effectively achieved by the voltage regulator in the voltage bypass mode.

9 Claims, 3 Drawing Sheets

VOLTAGE REGULATOR

CROSS-REFERENCE TO RELATED APPLICATION

This application claims the priority benefit of Chinese application serial no. 202011237188.3, filed on Nov. 9, 2020. The entirety of the above-mentioned patent application is hereby incorporated by reference herein and made a part of this specification.

BACKGROUND

Technical Field

The disclosure relates to a voltage regulator, in particular to a voltage regulator with a soft-start mechanism.

Description of Related Art

In the common knowledge of voltage regulators, it has been a trend to provide a bypass mode so that the voltage regulator can directly generate an output voltage close to the operating power. However, in the bypass mode, when the voltage output circuit of the voltage regulator is turned on, the generated output voltage rapidly rises from 0 volts to the operating power (for example, 5 volts). As a result, the output stage of the voltage regulator may generate a very large current, and may damage a circuit. Therefore, enabling the voltage regulator to perform a soft-start mechanism in the voltage bypass mode has become an issue to work on.

SUMMARY

The disclosure is directed to a voltage regulator, which can perform a soft-start mechanism during a startup time interval in a voltage bypass mode.

According to an embodiment of the disclosure, the voltage regulator includes an amplifier, a start signal generator, and a power transistor. The amplifier has a first positive input terminal, a second positive input terminal, and a negative input terminal to receive respectively a start signal, a reference voltage and a feedback voltage. An output terminal of the amplifier generates a driving voltage. The start signal generator is coupled to the first positive input terminal of the amplifier. The start signal generator generates the start signal, which is incremental, during a startup time interval in a voltage bypass mode. The power transistor generates an output voltage according to the driving voltage based on an operating power. In the voltage bypass mode, the reference voltage is equal to the operating power.

According to the above, in the voltage regulator according to the embodiments of the invention, during the startup time interval in the voltage bypass mode, the reference voltage received by the amplifier is set to be equal to the power supply voltage, and makes the other positive input terminal of the amplifier receive a start signal incremental over time, so as to perform a soft start.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
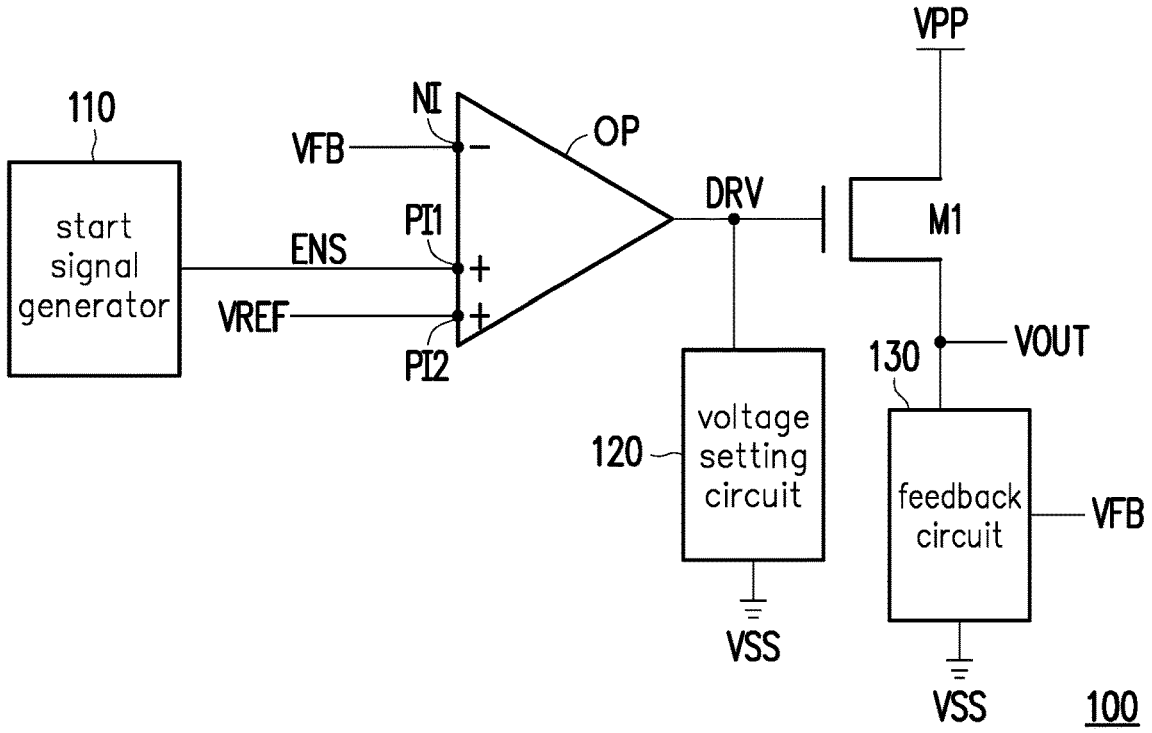
FIG. 1 is a schematic diagram of a voltage regulator according to an embodiment of the disclosure.

Reference will now be made in detail to the exemplary embodiments of the present disclosure, and examples of the exemplary embodiments are illustrated in the accompanying drawings. Whenever possible, the same component symbols are used in the drawings and descriptions to indicate the same or similar parts.

Referring to FIG. 1, FIG. 1 is a schematic diagram of a voltage regulator according to an embodiment of the disclosure. A voltage regulator 100 includes an amplifier OP, a start signal generator 110, a voltage setting circuit 120, a feedback circuit 130, and a power transistor M1. The amplifier OP has a first positive input terminal PI1, a second positive input terminal PI2 and a negative input terminal NI. The first positive input terminal PI1 and the second positive input terminal PI2 of the amplifier OP receive respectively a start signal ENS and a reference voltage VREF, and the negative input terminal NI of the amplifier OP is used for receiving a feedback voltage VFB. An output terminal of the amplifier OP is used to generate a driving voltage DRV. The start signal generator 110 is coupled to the first positive input terminal PH of the amplifier OP to provide the start signal ENS. A control terminal of the power transistor M1 is coupled to the output terminal of the amplifier OP to receive the driving voltage DRV. In addition, a first terminal of the power transistor M1 receives an operating power VPP, and a second terminal of the power transistor M1 generates an output voltage VOUT.

The output voltage VOUT is provided to the feedback circuit 130. The feedback circuit 130 divides the output voltage VOUT to generate the feedback voltage VFB. The voltage setting circuit 120 is coupled to the output terminal of the amplifier OP. The voltage setting circuit 120 may be turned on in a voltage bypass mode, and lower the level of the driving voltage DRV according to the current provided by the output terminal of the amplifier OP.

In the embodiment of the disclosure, in the voltage bypass mode, the reference voltage VREF received by the amplifier OP is set to be equal to the operating power VPP. During the startup time interval in the voltage bypass mode, the start signal generator 110 provides the start signal ENS incremental over time. The amplifier OP adjusts the driving voltage DRV by comparing the start signal ENS and the feedback voltage VFB, and drives the power transistor M1 to generate the output voltage VOUT which rises gradually. By controlling the rising rate of the start signal ENS, the rising rate of the output voltage VOUT may be adjusted, so as to carry out a soft start.

In addition, during the startup time interval in the voltage bypass mode, in this embodiment, when the output voltage VOUT rises to a default voltage (for example, equal to an operating power VPP-VDS, VDS being the voltage difference between two terminals when the power transistor M1 operates in the saturation region), the amplifier OP stops comparing the start signal ENS and the feedback voltage VFB, and the voltage setting circuit 120 is turned on. The voltage setting circuit 120 lowers the driving voltage DRV according to the current provided by the output terminal of the amplifier OP, and enables the power transistor M1 to generate the output voltage VOUT equal to the operating power VPP. The power transistor M1 is a P-type transistor.

In the voltage bypass mode, the output voltage VOUT may be substantially equal to the operating power VPP. Of course, the power transistor M1 may have a slight ON-resistance at this time. Therefore, the output voltage VOUT may be slightly lower than the operating power VPP.

In addition, in the normal mode that is not the voltage bypass mode, the reference voltage VREF received by the second input terminal PI2 of the amplifier OP may be an input voltage lower than the operating power VPP. At this time, the start signal ENS received by the first input terminal PI1 of the amplifier OP may be equal to the operating power VPP.

Figure 2:
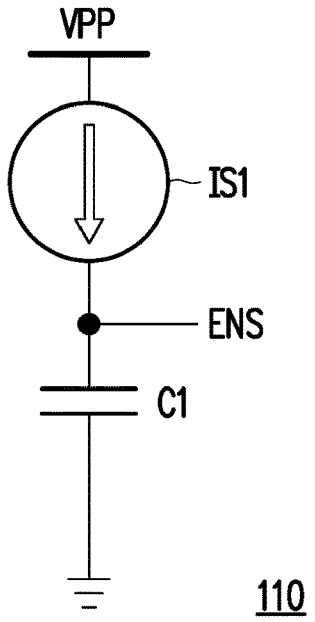
FIG. 2 is a schematic diagram of the implementation of a start signal generator of the voltage regulator in the embodiment of FIG. 1 of the disclosure.

Referring to FIG. 2, FIG. 2 is a schematic diagram of an implementation of the start signal generator of the voltage regulator in the embodiment of FIG. 1 of the disclosure. The start signal generator 110 includes a current source IS1 and a capacitor C1. A terminal of the current source IS1 receives the operating power VPP, and the other terminal of the current source IS1 is coupled to the capacitor C1. The capacitor C1 is connected in series between the current source IS1 and a reference ground terminal VSS. During the startup time interval of the voltage bypass mode, the current source IS1 provides a current to the capacitor C1 and gradually raises the start signal ENS. In this embodiment, by reducing the current provided by the current source IS1 and providing the capacitor C1 having a large capacitance, the rate at which the level of the start signal ENS rises during the startup time interval may be decreased, and the effect of soft-start can be reinforced.

In terms of hardware design, with one or more transistors connected in series and operating in the saturation region, the current source IS1 may provide a stable current. Under the condition that the current source IS1 is a fixed current source, the start signal ENS may be a ramp signal. In addition, the capacitor C1 may be a transistor capacitor, or may also be formed by any arbitrary semiconductor material or component. The disclosure is not particularly limited in this regard.

Figure 3:
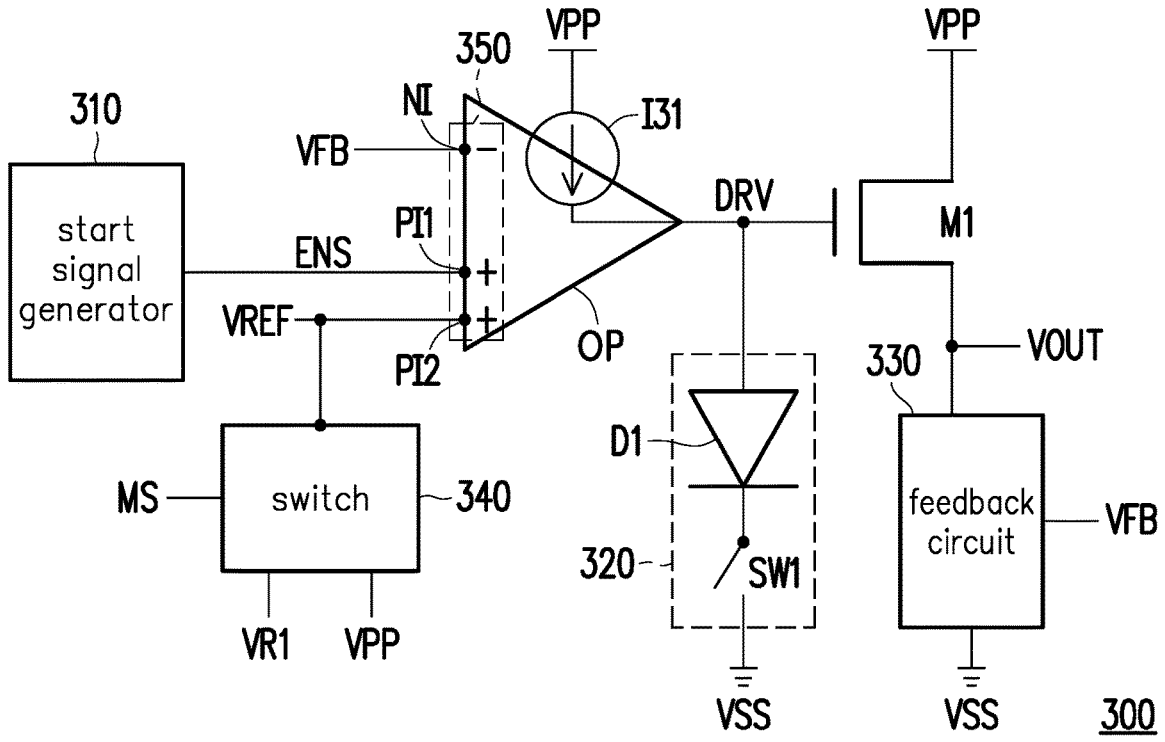
FIG. 3 is a schematic diagram of a voltage regulator according to another embodiment of the disclosure.

Referring to FIG. 3, FIG. 3 is a schematic diagram of a voltage regulator according to another embodiment of the disclosure. A voltage regulator 300 includes the amplifier OP, a start signal generator 310, a voltage setting circuit 320, a feedback circuit 330, a switch 340, and the power transistor M1. The amplifier OP has an input stage circuit 350 and a current source 131 coupled to the output terminal. The input stage circuit 350 is coupled to the first positive input terminal PI1, the second positive input terminal PI2, and the negative input terminal NI. The input stage circuit 350 receives respectively the start signal ENS, the reference voltage VREF, and the feedback voltage VFB through the first positive input terminal PI1, the second positive input terminal PI2, and the negative input terminal NI. The first positive input terminal PH and the second positive input terminal PI2 are respectively coupled to the start signal generator 310 and the switch 340. The start signal generator 310 is used to generate the start signal ENS, and the switch 340 selects the input voltage VR1 or the operating power VPP as the reference voltage VREF according to the control signal MS.

In addition, the voltage setting circuit 320 includes a diode D1 and a switch SW1. The diode D1 and the switch SW1 are connected in series between the output terminal of the amplifier OP and the reference ground terminal VSS. The anode of the diode D1 is coupled to the output terminal of the amplifier OP. The cathode of the diode D1 is coupled to a terminal of the switch SW1, and the other terminal of the switch SW1 is coupled to the reference ground terminal VSS. In other embodiments, the diode D1 in the voltage setting circuit 320 may also be changed to a resistor or a transistor. Any component that can provide a resistance value and raise the voltage according to the received current may serve to replace the diode D1.

In the voltage bypass mode, during the startup time interval, the switch 340 selects the operating power VPP as the reference voltage VREF according to the control signal MS. At this time, the switch SW1 in the voltage setting circuit 320 is turned off, and the voltage setting circuit 320 is shut off accordingly. The input stage circuit 350 of the amplifier OP compares the start signal ENS, which rises gradually, and the feedback voltage VFB to generate the driving voltage DRV. At this time, the power transistor M1 generates the output voltage VOUT, which rises gradually, according to the driving voltage DRV. Then, when the output voltage VOUT rises to a default value (for example, equal to the operating power VPP-VDS, VDS being the voltage difference between two terminals when the power transistor M1 operates in the saturation region), the input stage circuit 350 of the amplifier OP is shut off, and switch SW1 in the voltage setting circuit 320 is turned on. The voltage setting circuit 320 is turned on and lowers the level of the driving voltage DRV according to the current provided by the current source 131, and enables the power transistor M1 to generate the output voltage VOUT equal to the operating power VPP.

If the voltage regulator 300 operates in a mode that is not the voltage bypass mode (i.e., operating in the normal mode), the input stage circuit 350 may operate normally, and the switch 340 may select the input voltage VR1 as the reference voltage VREF. At the same time, the voltage setting circuit 320 is shut off. The amplifier OP may generate the driving voltage DRV by comparing the input voltage VR1 and the feedback voltage VFB. The power transistor M1 generates the output voltage VOUT lower than the operating power VPP according to the driving voltage DRV. At this time, the voltage regulator 300 is a low drop-out (LDO) voltage generator.

Figure 4:
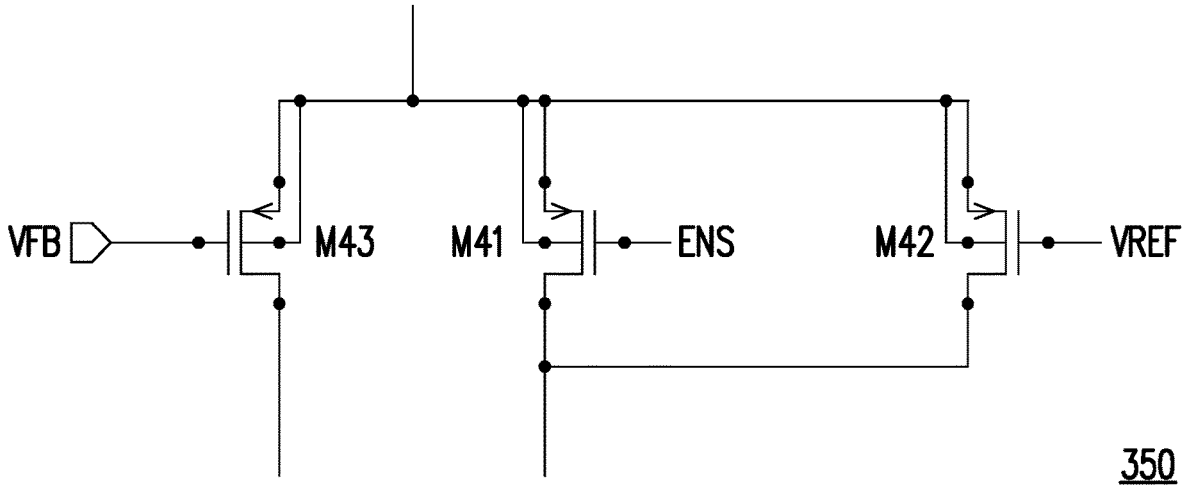
FIG. 4 is a schematic diagram of the implementation of an input stage circuit in the embodiment of FIG. 3 of the disclosure.

Regarding the implementation details of the input stage circuit 350 of the amplifier OP, FIG. 4 illustrates a schematic diagram of the implementation of the input stage circuit in the embodiment of FIG. 3 of the disclosure. The input stage circuit 350 includes transistors M41 to M43. The transistors M41 to M43 have first terminals that are commonly coupled. The second terminals of the transistors M41 and M42 may be coupled to each other, but are not directly connected to the third terminal of the transistor M43. The control terminals of the transistors M41 to M43 respectively receive the start signal ENS, the reference voltage VREF, and the feedback voltage VFB. In this embodiment, the transistors M41 to M43 may be P-type transistors. When the control terminal of any of the transistors M41 and M42 receives the operating power VPP, corresponding transistors MP41 and MP42 are cut off.

In this embodiment, the amplifier OP is a differential amplifier. The commonly coupled first terminals of the transistors M41 to M43 may be coupled to the internal current source of the amplifier OP, and the second terminals of the transistors M41 and M43 may be respectively coupled to two terminals of an active load inside the amplifier OP. The internal current source and the active load of the amplifier OP may be respectively implemented according to current sources and active load circuits well known in the conventional art. The disclosure is not particularly limited in this regard.

Figure 5:
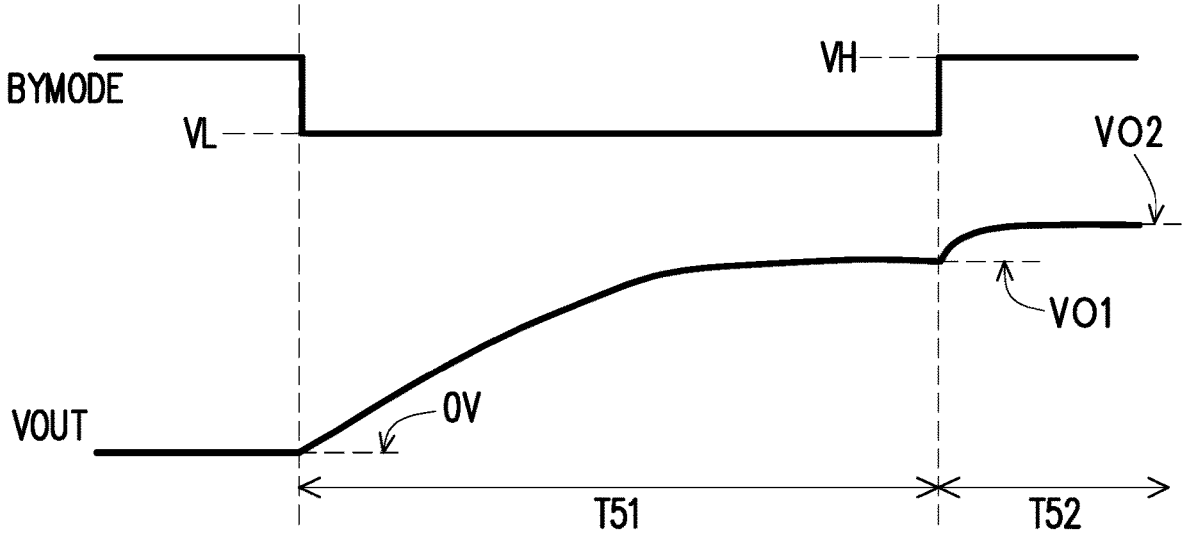
FIG. 5 is an operation waveform diagram of the voltage regulator according to the embodiment of the disclosure.

Referring to FIGS. 3 and 5 together, FIG. 5 shows an operation waveform diagram of the voltage regulator according to the embodiment of the disclosure. In FIG. 5, the operation of the voltage regulator 300 may be controlled according to a mode selection signal BYMODE. The mode selection signal BYMODE may be input from the outside of the voltage regulator 300 to operate the voltage regulator 300 to enter the voltage bypass mode.

During the startup time interval when the voltage regulator 300 enters the voltage bypass mode, the mode selection signal BYMODE can be switched from a relatively high voltage VH to a relatively low voltage VL during a first time interval T51. At this time, the second positive input terminal PI2 of the input stage circuit 350 of the amplifier OP receives the operating power VPP provided by the switch 340 as the reference voltage VREF, and the voltage setting circuit 320 is turned off. Furthermore, the amplifier OP generates the driving voltage DRV by comparing the feedback voltage VFB on the negative input terminal NI and the start signal ENS on the first positive input terminal PI1. Meanwhile, the start signal generator 310 is also turned on in response to the mode selection signal BYMODE, and generates the start signal ENS which rises gradually. In this way, the amplifier OP may generate the driving voltage DRV which rises gradually, and the power transistor M1 may generate the output voltage VOUT gradually rising from 0V according to the driving voltage DRV. During the time interval T51, the output voltage VOUT may gradually rise to a voltage VO1, and the voltage VO1 is less than the operating power VPP.

Then, during a time interval T52, the mode selection signal BYMODE may be switched from the relatively low voltage VL to the relatively high voltage VH. At this time, the input stage circuit 350 of the amplifier OP is shut off and the voltage setting circuit 320 is turned on. The driving voltage DRV on the output terminal of the amplifier OP is controlled by the voltage setting circuit 320, and the level of the driving voltage DRV is lowered through the diode D1 according to the current provided by the current source 131 of the amplifier OP. In this way, the power transistor M1 may generate the output voltage VOUT equal to a voltage VO2 according to the risen driving voltage DRV. The voltage VO2 is greater than the voltage VO1, and the voltage VO2 may be equal to the operating power VPP.

According to the above, the voltage regulator of the disclosure provides the start signal to one of the positive input terminals of the amplifier, and makes the other of the positive input terminals of the amplifier receive the operating power in the voltage bypass mode. In this way, in the voltage bypass mode, the voltage regulator may allow the generated output voltage to rise slowly during the startup time interval, so as to perform a soft-start.

It will be apparent to those skilled in the art that various modifications and variations can be made to the structure of the disclosure without departing from the scope or spirit of the invention. In view of the foregoing, it is intended that the disclosure cover modifications and variations of this invention provided they fall within the scope of the following claims and their equivalents.

What is claimed is:

1. A voltage regulator, comprising:

an amplifier, having a first positive input terminal, a second positive input terminal and a negative input terminal to receive respectively a start signal, a reference voltage and a feedback voltage, wherein an output terminal of the amplifier generates a driving voltage;

a start signal generator, coupled to the first positive input terminal of the amplifier, and generating the start signal, which is incremental, during a startup time interval in a voltage bypass mode;

a power transistor, generating an output voltage according to the driving voltage based on an operating power; and a voltage setting circuit, coupled between the output terminal and the reference ground voltage, and increasing the driving voltage on the output terminal according to a current provided by an output stage circuit of the amplifier after the startup time interval in the voltage bypass mode, wherein the reference voltage is equal to the operating power in the voltage bypass mode.

2. The voltage regulator according to claim 1, wherein the start signal generator raises the start signal from a reference ground voltage to be equal to the operating power during the startup time interval.

3. The voltage regulator according to claim 1, wherein the start signal generator comprises:

a current source, providing a charging current based on the operating power during the startup time interval; and a capacitor, receiving the charging current to generate the start signal.

4. The voltage regulator according to claim 3, wherein the start signal is a ramp signal during the startup time interval.

5. The voltage regulator according to claim 3, wherein the current source comprises at least one transistor, a terminal of the at least one transistor receives the operating power, and another terminal of the at least one transistor is coupled to the capacitor.

6. The voltage regulator according to claim 1, wherein the voltage setting circuit is a diode, a resistor, or a transistor.

7. The voltage regulator according to claim 6, the amplifier comprising:

an input stage circuit, having a first transistor, a second transistor, and a third transistor, wherein gates of the first transistor, the second transistor, and the third transistor respectively receive the start signal, the reference voltage, and the feedback voltage, and the second transistor is cut off in the voltage bypass mode.

8. The voltage regulator according to claim 7, wherein in the voltage bypass mode, during a first time interval of the startup time interval, the input stage circuit is turned on, and the amplifier generates the driving voltage by comparing the start signal and the feedback signal, and during a second time interval after the first time interval, the input stage circuit is shut off, and the voltage setting circuit is turned on to raise the driving voltage according to the current provided by the output stage circuit of the amplifier.

9. The voltage regulator according to claim 1, further comprising:

a switch, coupled to the amplifier, selecting an input voltage or the operating power as the reference voltage according to a control signal.

* * * * *